US009466885B1

(12) United States Patent
Farmahini Farahani et al.

(10) Patent No.: US 9,466,885 B1
(45) Date of Patent: Oct. 11, 2016

(54) RECONFIGURABLE ANTENNA

(71) Applicant: QUALCOMM Incorporated, San Diego, CA (US)

(72) Inventors: Mohsen Farmahini Farahani, San Diego, CA (US); Allen Minh-Triet Tran, San Diego, CA (US)

(73) Assignee: QUALCOMM INCORPORATED, San Diego, CA (US)

( * ) Notice: Subject to any disclaimer, the term of this patent is extended or adjusted under 35 U.S.C. 154(b) by 0 days.

(21) Appl. No.: 14/743,377

(22) Filed: Jun. 18, 2015

(51) Int. Cl.

| | |
|---|---|
| ***H01Q 1/00*** | (2006.01) |
| ***H01Q 13/10*** | (2006.01) |
| ***H01Q 1/48*** | (2006.01) |
| ***H01Q 9/04*** | (2006.01) |
| *H01Q 5/00* | (2015.01) |
| *H01Q 21/06* | (2006.01) |
| *H01Q 3/24* | (2006.01) |
| *H01Q 21/28* | (2006.01) |
| *H01Q 3/26* | (2006.01) |

(52) U.S. Cl.
CPC ..... *H01Q 13/10* (2013.01); *H01Q 1/48* (2013.01); *H01Q 9/0407* (2013.01); *H01Q 3/24* (2013.01); *H01Q 3/26* (2013.01); *H01Q 5/00* (2013.01); *H01Q 21/061* (2013.01); *H01Q 21/28* (2013.01)

(58) Field of Classification Search
CPC ..... H01Q 3/24; H01Q 21/28; H01Q 5/00; H01Q 3/26; H01Q 21/061
USPC ..... 343/724, 727, 852, 853, 893
See application file for complete search history.

(56) References Cited

U.S. PATENT DOCUMENTS

| | | | | |
|---|---|---|---|---|
| 7,106,270 | B2 | 9/2006 | Iigusa et al. | |
| 7,724,189 | B2 | 5/2010 | Lee | |
| 8,319,694 | B2 | 11/2012 | Yang et al. | |
| 2011/0163936 | A1* | 7/2011 | Schneider ..... | H01Q 3/247 343/893 |

FOREIGN PATENT DOCUMENTS

| | | | |
|---|---|---|---|
| CN | 104157980 | A | 11/2014 |
| WO | 2009023551 | A1 | 2/2009 |

* cited by examiner

*Primary Examiner* — Joseph Lauture
(74) *Attorney, Agent, or Firm* — Arent Fox LLP

(57) ABSTRACT

A method and an apparatus for a reconfigurable antenna are provided. The apparatus is a reconfigurable antenna including a patch antenna and one or more parasitic slots. The patch antenna includes a first conductor plane and a second conductor plane. The second conductor plane is configured to provide a ground plane for the first conductor plane. The reconfigurable antenna further includes a first parasitic slot of the one or more parasitic slots formed in the second conductor plane. The first parasitic slot of the one or more parasitic slots is formed by a first set of two opposing portions of the second conductor plane. The first set of two opposing portions is separated by a first cutout in the second conductor plane. The reconfigurable antenna further includes a first switch configured to enable or disable the first parasitic slot of the one or more parasitic slots.

30 Claims, 4 Drawing Sheets

RECONFIGURABLE ANTENNA

BACKGROUND

1. Field

The present disclosure relates generally to antennas, and more particularly, to reconfigurable antennas.

2. Background

Wireless communication systems are widely deployed to provide various telecommunication services such as telephony, video, data, messaging, and broadcasts. Typical wireless communication systems may employ multiple-access technologies capable of supporting communication with multiple users by sharing available system resources (e.g., bandwidth, transmit power). Examples of such multiple-access technologies include, code division multiple access (CDMA) systems, time division multiple access (TDMA) systems, frequency division multiple access (FDMA) systems, orthogonal frequency division multiple access (OFDMA) systems, single-carrier frequency divisional multiple access (SC-FDMA) systems, and time division synchronous code division multiple access (TD-SCDMA) systems. Generally, these wireless communication systems may transmit data, receive data, or both transmit data and receive data using an antenna, antennas, or an antenna system.

Path loss in millimeter-wave may be high for wireless communications. Accordingly, in some cases, a high gain antenna array may generally be used to satisfy high data throughput requirements for various systems. Generally, the higher gain the antenna array has, the narrower the antenna array's beam becomes. The narrow beam characteristic of such a high-gain antenna system may generally lead to a need for beam steering for mobile applications where the location of a mobile device (and the mobile device's antenna) may be changing relative to other devices the mobile device is communicating with. As the beam of an antenna array is electronically steered to a certain direction, its gain is the product of the individual antenna element gain in that direction and the array factor. For improved system throughput, it may be necessary to have close to uniform antenna gain level in all directions. Accordingly, for improved system throughput, the individual antenna elements in the array would need to have omni-directional pattern characteristic. Antenna elements used in high-gain antenna arrays today do not have omni-directional pattern. Rather, currently, multiple antenna arrays are used to provide 360° of coverage. The use of multiple antenna arrays may increase system costs. Accordingly, an antenna system that uses a single antenna or a single antenna array in place of multiple antenna arrays may be useful and may decrease one or more of costs, space, or power.

SUMMARY

In an aspect of the disclosure, a method and an apparatus for a reconfigurable antenna are provided. The apparatus is a reconfigurable antenna including a patch antenna and one or more parasitic slots. The patch antenna includes a first conductor plane and a second conductor plane. The second conductor plane is configured to provide a ground plane for the first conductor plane. The reconfigurable antenna further includes a first parasitic slot of the one or more parasitic slots formed in the second conductor plane. The first parasitic slot of the one or more parasitic slots is formed by a first set of two opposing portions of the second conductor plane. The first set of two opposing portions is separated by a first cutout in the second conductor plane. The reconfigurable antenna further includes a first switch configured to enable or disable the first parasitic slot of the one or more parasitic slots.

DETAILED DESCRIPTION

Figure 1:
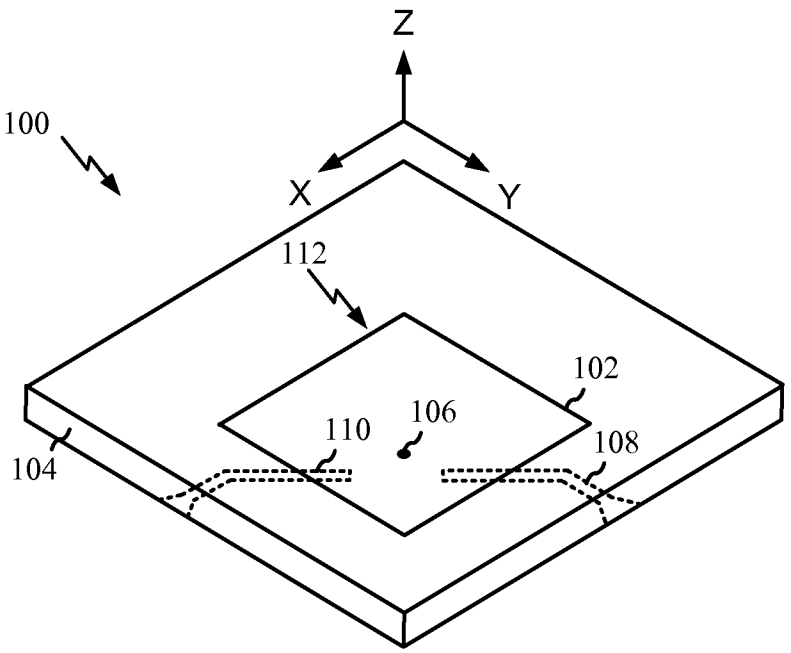
FIG. 1 is a diagram illustrating an example antenna structure for a reconfigurable antenna in accordance with this disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well-known structures and components are shown in block diagram form in order to avoid obscuring such concepts.

Several aspects of reconfigurable antennas will now be presented with reference to various apparatus and methods. These apparatus and methods will be described in the following detailed description and illustrated in the accompanying drawings by various blocks, modules, components, circuits, steps, processes, and algorithms (collectively referred to as "elements"). These elements may be implemented using electronic hardware, computer software, or any combination thereof. Whether such elements are implemented as hardware or software depends upon the particular application and design constraints imposed on the overall system.

By way of example, an element, or any portion of an element, or any combination of elements may be implemented with a "processing system" that includes one or more processors. Examples of processors include microprocessors, microcontrollers, digital signal processors (DSPs), field programmable gate arrays (FPGAs), programmable logic devices (PLDs), state machines, gated logic, discrete hardware circuits, and other suitable hardware configured to perform the various functionality described throughout this disclosure. One or more processors in the processing system may execute software. Software shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

Accordingly, in one or more exemplary embodiments, the functions described may be implemented in hardware, software, firmware, or any combination thereof. If implemented in software, the functions may be stored on or encoded as one or more instructions or code on a computer-readable medium. Computer-readable media includes computer storage media. Storage media may be any available media that can be accessed by a computer. By way of example, and not limitation, such computer-readable media can comprise a random-access memory (RAM), a read-only memory (ROM), an electrically erasable programmable ROM (EEPROM), compact disk ROM (CD-ROM) or other optical disk storage, magnetic disk storage or other magnetic storage devices, combinations of the aforementioned types of computer-readable media, or any other medium that can be used to store computer-executable code in the form of instructions or data structures that can be accessed by a computer.

It is understood that the specific order or hierarchy of blocks in the processes/flowcharts disclosed is an illustration of exemplary approaches. Based upon design preferences, it is understood that the specific order or hierarchy of blocks in the processes/flowcharts may be rearranged. Further, some blocks may be combined or omitted. The accompanying method claims present elements of the various blocks in a sample order, and are not meant to be limited to the specific order or hierarchy presented.

FIG. 1 is a diagram illustrating an example antenna structure for a reconfigurable antenna 100. The reconfigurable antenna 100 includes a patch 102. The patch 102 may be on a substrate 104. Additionally, the reconfigurable antenna 100 of FIG. 1 includes two parasitic slots 108, 110. The two parasitic slots 108, 110 may be on a bottom side of the substrate 104 (e.g., when the side of the substrate 104 that the patch 102 is on is considered the top side of the substrate). Generally, the reconfigurable antenna 100 in accordance with the systems and methods described herein may include one or more parasitic slots such as the two parasitic slots 108, 110 illustrated in FIG. 1. In some cases, e.g., in an array of patch antennas, one or more patch antennas in the array of patch antennas may have no parasitic slots. When an antenna array is used, one or more patch antennas in the antenna array may have no parasitic slots, one parasitic slot, two parasitic slots, or more parasitic slots, as will be described in more detail with respect to FIG. 3 discussed below.

The reconfigurable antenna 100 of FIG. 1 also includes a pin feed 106. The pin feed 106 may be used to connect a radio frequency (RF) signal to the reconfigurable antenna 100 and, more specifically, the pin feed 106 may be used to connect an RF signal to the patch 102. In the illustrated example of FIG. 1, the pin feed 106 is not directly connected to the two parasitic slots 108, 110. The two parasitic slots 108, 110, however, may impact the radiation pattern of the reconfigurable antenna 100. That is, the general direction of signal transmission may change depending on the state of the two parasitic slots 108, 110, as is described below.

A patch antenna 112 includes a first conductor plane, i.e., patch 102. The patch 102 may generally be a flat rectangular sheet of metal (or another conductor) on a substrate 104. The flat rectangular sheet of metal (patch 102) may form the "patch" of the patch antenna 112. The patch antenna 112 also includes a second conductor plane, e.g., a ground plane under the patch 102. The first conductor plane (patch 102) and the second conductor plane (the ground plane) may be separated by the substrate 104.

The ground plane for the patch antenna may include the two parasitic slots 108, 110. As illustrated in FIG. 1, the patch 102 is generally a flat generally square sheet of metal. It will be understood, however that the particular shape of the sheet of metal may vary depending on the particular implementation, for example, the patch may be generally square as illustrated in FIG. 1, generally rectangular, or generally circular. In some examples, the patch may be an irregular shape. The patch may generally be any shape that a sheet of metal might be formed into.

In some examples, the patch antenna 112 includes a first parasitic slot 108 of the one or more parasitic slots that are formed in a second conductor plane and a second parasitic slot 110 of the one or more parasitic slots that is formed in a second conductor plane. The first parasitic slot 108 and the second parasitic slot 110 are both formed by two opposing portions of the second conductor plane. The opposing portions are each separated by cut-outs in the second conductor plane, which may be on the bottom of the substrate 104 as is discussed in more detail with respect to FIG. 2 described below.

Figure 2:
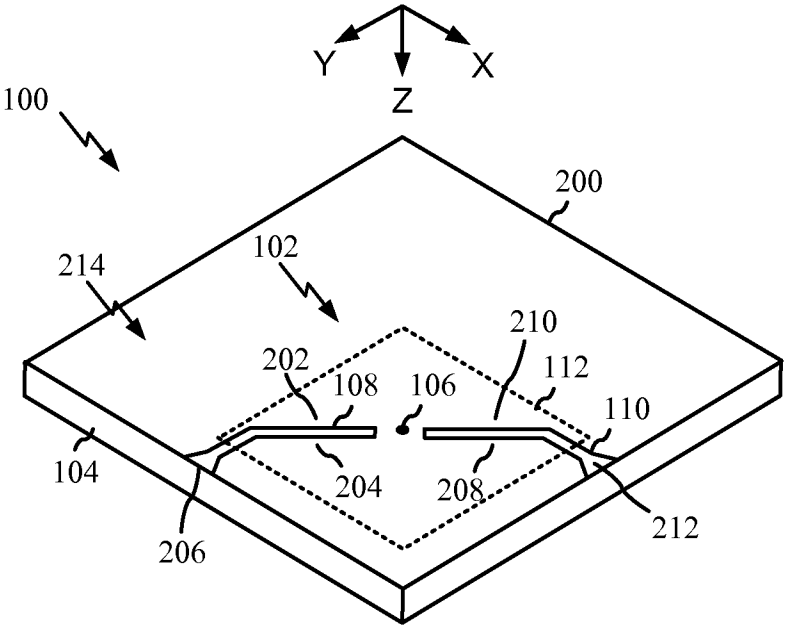
FIG. 2 is a diagram illustrating another aspect of the example antenna structure for the reconfigurable antenna of FIG. 1.

FIG. 2 is a diagram illustrating another aspect of the example antenna structure for the reconfigurable antenna 100 of FIG. 1. As illustrated in FIG. 2, the patch antenna 112 may also include a second conductor plane 200, e.g., on the bottom of substrate 104. (The words "top" and "bottom" may be used to describe sides of the reconfigurable antenna 100 or components of the reconfigurable antenna 100. As used with respect to FIGS. 1 and 2, the word "top" is used to indicate the side of reconfigurable antenna 100 that includes the patch antenna 112 and the word "bottom" is used to indicate the side of the reconfigurable antenna 100 that includes the first parasitic slot 108 and the second parasitic slot 110.)

The second conductor plane 200 may be a ground plane. Accordingly, the first conductor plane, i.e., patch 102 may be over the second conductor plane 200 and the second conductor plane 200 may be configured to provide a ground plane for the first conductor plane, patch 102 to form the patch antenna 112. Generally, the ground plane may be larger than the patch 102. It may be advantageous for the ground plane to be much larger than the first conductor plane. It will be understood, however that the size of the ground plane may generally be limited by the size of the substrate 104. In some examples, the ground plane may use up a substantial percentage of the bottom layer of the substrate 104, e.g., near 100%. Some of the area, however, may be removed to form the first parasitic slot 108 and the second parasitic slot 110.

As described above, the patch antenna 112 of FIGS. 1 and 2 includes a first parasitic slot 108 of the one or more parasitic slots that are formed in the second conductor plane 200. The first parasitic slot 108 of the one or more parasitic slots is formed by a first set of two opposing portions 202, 204 of the second conductor plane 200. The two opposing portions 202, 204 are separated by a first cutout 206 in the second conductor plane 200. The first set of two opposing portions 202, 204 is on the bottom of the substrate 104 in the illustrated example of FIG. 2.

The reconfigurable parasitic slot 108 is reconfigurable by either opening or closing a first switch (not shown). The first switch is across the parasitic slot 108 such that the two opposing portions 202, 204 of the first parasitic slot 108 may be connected and disconnected. When the first switch is open, the two opposing portions 202, 204 of the first parasitic slot 108 are not shorted together. Accordingly, the first parasitic slot 108 forms a slot which may radiate electromagnetic signals and may generally change the overall direction which electromagnetic signals are radiated from the reconfigurable antenna 100. Conversely, when the first switch is closed the two opposing portions 202, 204 of the first parasitic slot 108 are shorted together. Accordingly the first parasitic slot is shorted out and generally does not radiate electromagnetic signals and generally does not change the overall direction which electromagnetic signals are radiated from reconfigurable antenna 100. The impact of the first parasitic slot 108 may be minimized due to the first parasitic slot 108 being shorted out, e.g., by a switch. Generally, when the first parasitic slot 108 is shorted, it electrically appears as if this first parasitic slot 108 is not present in the ground plane.

The patch antenna 112 of FIGS. 1 and 2 also includes a second parasitic slot 110 of the one or more parasitic slots that are formed in the second conductor plane 200. The second parasitic slot 110 of the one or more parasitic slots is formed by a second set of two opposing portions 208, 210 of the second conductor plane 200. The two opposing portions 208, 210 of the second conductor plane 200 are separated by a second cutout 212 in the second conductor plane 200. The second set of two opposing portions 208, 210 is also on the bottom of the substrate 104 in the illustrated example of FIG. 2.

The reconfigurable parasitic slot 110 is also reconfigurable by either opening or closing a switch (not shown). The second switch (not shown) is across the parasitic slot 110 such that the two opposing portions 208, 210 of the second parasitic slot 110 may be connected and disconnected. When the second switch is open, the two opposing portions 208, 210 of the second parasitic slot 110 are not shorted together. Accordingly, the second parasitic slot 110 forms a slot which may radiate electromagnetic signals and may generally change the overall direction which electromagnetic signals are radiated from the reconfigurable antenna 100. Conversely, when the second switch is closed the two opposing portions 208, 210 of the second parasitic slot 110 are shorted together. Accordingly the second parasitic slot is shorted out and generally does not radiate electromagnetic signals and generally does not change the overall direction which electromagnetic signals are radiated from reconfigurable antenna 100. The impact of second parasitic slot 110 may be minimized due to the second parasitic slot 110 being shorted out, e.g., by a switch. Generally, when the second parasitic slot 110 is shorted, it electrically appears as if this second parasitic slot 110 is not present in the ground plane.

As described herein, the first switch and the second switch are both used to make connections across one of the parasitic slots 108, 110. Neither the first switch nor the second switch is connected to pin feed 106. The first switch and the second switch do not couple or decouple signals to the first parasitic slot 108 or the second parasitic slot 110 respectively. Rather, as described above, the first switch shorts the two opposing portions 202, 204 together when the first switch is closed and does not short the two opposing portions 202, 204 together when the first switch is open. Thus, when the two opposing portions 202, 204 are shorted together, it is as if the parasitic slot 108 is not in the second conductor plane 200. Electrically it is generally as if the second conductor plane 200 is a solid sheet of metal in the region near parasitic slots 108 because the two opposing portions 202, 204 are shorted together by the first switch. Similarly, the second switch shorts the two opposing portions 208, 210 together when the second switch is closed and does not short the two opposing portions 208, 210 when the second switch is open. Thus, again when the two opposing portions 208, 210 are shorted together it is as if the parasitic slots 110 is not in the second conductor plane 200. Electrically, it is generally as if the second conductor plane 200 is a solid sheet of metal in the region near parasitic slot 110 when the two opposing portions 208, 210 are shorted together by the second switch. While the switches described herein are used to short or not short one of the two opposing portions 202, 204 or two opposing portions 208, 210, and these switches do not make a connection with pin feed 106 or break a connection with pin feed 106, nothing in this discussion is intended to imply that other switches might be added to the illustrated example to connect or disconnect a signal from pin feed 106 or other connection pins described herein.

As illustrated in FIGS. 1 and 2, the first reconfigurable parasitic slot 108 and the second reconfigurable parasitic slots 110 may be formed in the second conductor plane. The reconfigurable antenna 100 is thus a patch antenna element (patch antenna 112) with reconfigurable parasitic slots 108, 110 in the second conductor plane 200. In the illustrated example of FIG. 1, the parasitic slots 108, 110 are in the second conductor plane 200 under the active patch radiator (patch antenna 112). Thus, the parasitic slots 108, 110 are integrated into the patch antenna 112 ground.

The parasitic slots 108, 110 may have built-in single pole single throw switches that may be turned on or off to reconfigure the antenna pattern. As described above, when a switch is on, electrically, the slot associated with that particular switch is electrically not present. Accordingly, the combination of patch antenna 112 and parasitic slots 108, 110 may be configured to change the direction of coverage of the reconfigurable antenna 100. The patch antenna 112 may be used for broadside direction coverage, directions z. One of the parasitic slots 108 may be used for end fired direction y and the parasitic slot 110 may be used for endfire direction x.

The state of the switches in the slot determines the radiation mode. In a first state, the switches are both on. When the switches are both on, electrically it appears as if the second conductor plane 200 (a ground plane) is a solid ground plane with no parasitic slots 108, 110. Accordingly, most of the electrical energy radiated by reconfigurable antenna 100 or most of the energy received by reconfigurable antenna 100 may be in or from the broadside or z-direction in the first state with the switches on. In other words, when the switches are both on electrically the antenna may generally be pointed in a direction perpendicular to the plane of the patch antenna 112.

In a second state, slot mode x, a switch associated with parasitic slot 108 is on and a switch associated with parasitic slot 110 is off. In this state, electrically it appears as if the reconfigurable antenna 100 includes a single parasitic slot 110. Electrically it appears as if there is no parasitic slot 108 because the parasitic slot 108 is shorted out by the switch associated with it. Accordingly, most of the electrical energy radiated by reconfigurable antenna 100 or most of the electrical energy received by the reconfigurable antenna may be in or from the x-direction.

In a third state, slot mode y, a switch associated with parasitic slot 108 is off and a switch associated with parasitic slot 110 is on. When the switches are in this state, electrically it appears as if the reconfigurable antenna 100 includes a single parasitic slot 108. Electrically it appears as if there is no parasitic slot 110 because the parasitic slot 110 is shorted out by the switch associated with it. Accordingly, most of the electrical energy radiated by reconfigurable antenna 100 or most of the electrical energy received by reconfigurable antenna 100 may be in or from the y-direction.

Thus, as described above one of the patch antenna 112, the first parasitic slot 108, and the second parasitic slot 110, may be a predominant electromagnetic radiator based on the state of the switches. As described above, the patch antenna 112 is the predominant electromagnetic radiator when the switches are both on. The parasitic slot 108 is the predominant electromagnetic radiator when the switch associated with the parasitic slot 108 is off and the switch associated with the parasitic slot 110 is on. The parasitic slot 110 is the predominant electromagnetic radiator when the switch associated with parasitic slot 108 is on and the switch associated with parasitic slot 110 is off. Generally, the two switches will not both be off at the same time. However, it will be understood that if the switches were both off at the same time then both parasitic slot 108 and parasitic slot 110 would generally be a predominant electromagnetic radiator when compared to the patch antenna 112. Accordingly, most of the electrical energy radiated by reconfigurable antenna 100 or most of the energy received by reconfigurable antenna 100 may be in or from both the x and the y-directions with both the switches off.

In the example of FIGS. 1 and 2, reconfigurable antenna 100 is a single antenna structure because the parasitic slot 108 and the parasitic slot 110 are formed within the ground plane of the patch antenna 112. Neither the parasitic slot 108 nor the parasitic slot 110 has a separate feed. Accordingly a single element with a single feed, i.e., reconfigurable antenna 100 with feed 106, may be used for all pattern coverage rather than multiple independent antenna elements. Thus, a single element may be used to cover all directions, i.e., both broadside and in the endfire directions. Hence, only one set of transceivers may be needed for the reconfigurable antenna 100. Furthermore, reconfigurable antenna 100 may save space, cost, and power. The space needed for reconfigurable antenna 100 may be less than the space needed for antenna systems using multiple independent antenna elements to cover different directions. In one example, the antenna element itself may be 20% smaller than a comparable antenna system using multiple independent antennas. Thus, the antenna module area and the chip area may be decreased. Cost may be reduced because the reconfigurable antenna 100 may be less expensive to produce when compared to antenna systems using multiple independent antenna elements to cover the different directions. This cost savings may be due in part due to the decreased space needed. Higher board space may in and of itself increase cost. Power and cost may be reduced at least because the reconfigurable antenna 100 may use a single transceiver rather than multiple transceivers.

The example reconfigurable antenna 100 of FIGS. 1 and 2 may be considered to be a "pattern reconfigurable antenna" or a "radiation pattern reconfigurable antenna" because the radiation pattern of the antenna is reconfigurable. As described above, the electrical energy radiated by reconfigurable antenna 100 or the energy received by pattern reconfigurable antenna 100 may be, for example, primarily in the x-direction, primarily in the y-direction, or primarily in the z-direction based on the state of the switches. Accordingly, the switches may be controlled to be "on" or "off" to intentional modification of the spherical distribution of the radiation pattern of the reconfigurable antenna 100.

Figure 3:
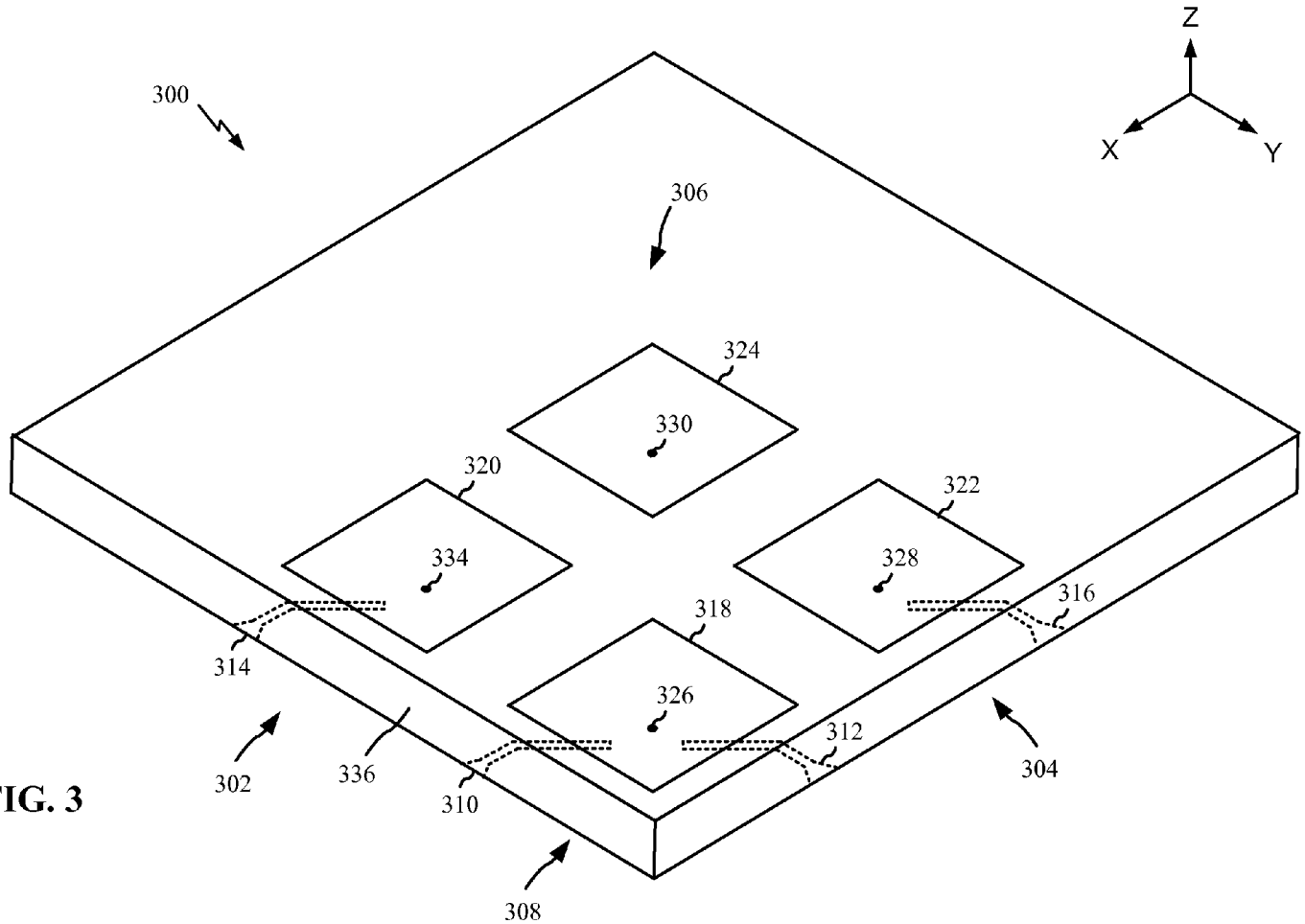
FIG. 3 is a diagram illustrating another example antenna structure for a reconfigurable antenna in accordance with this disclosure.

FIG. 3 is a diagram illustrating an example of an array of antenna structures 300 for a reconfigurable antenna in accordance with this disclosure. The array of antenna structures 300 illustrated in the example of FIG. 3 includes antenna structures 302, 304, 306, 308. The antenna structures 302, 304, 306, 308 may generally be similar to the reconfigurable antenna 100 of FIGS. 1 and 2. In particular, the antenna structure 308, which includes a parasitic slot 310 and a parasitic slot 312, may be similar to the structure of reconfigurable antenna 100. The antenna structures 302 and 304 are also generally similar to the structure of pattern reconfigurable antenna 100 of FIG. 1; however, the antenna structures 302, 304 each only include a single parasitic slot 314, 316, respectively. As illustrated in FIG. 3, the antenna structure 306 does not include a parasitic slot.

The parasitic slots 312, 316 may transmit or steer electromagnetic signals in the x-direction, i.e., the endfire direction out from both antenna structures 304, 308. The parasitic slots 310, 314 may transmit or steer electromagnetic signals in the y-direction, i.e., the endfire direction away from both antenna structures 302, 308.

The array of antenna structures 300 includes patches 318, 320, 322, 324. The patches 318, 320, 322, 324 may be on a substrate 336. Additionally, the array of antenna structures 300 of FIG. 3 includes four parasitic slots 310, 312, 314, 316 with two parasitic slots 310, 312 associated with patch 318, one parasitic slot 314 associated with patch 320, and one parasitic slot 316 associated with the patch 322. In the illustrated example of FIG. 3, the patch 324 does not include any parasitic slots.

One or more of the four parasitic slots 310, 312. 314. 316 may be on a bottom side of the substrate 336. (Generally, "top" and "bottom" may be used as described with respect to FIGS. 1 and 2.) The array of antenna structures 300 include three reconfigurable antennas, i.e., the antennas associated with patches 318, 320, 322. In the illustrated example, the array of antenna structures 300 includes one antenna, i.e., the antennas associated with the patch 324. In accordance with the systems and methods described herein, the antennas may include zero, one, two, or more parasitic slots.

Each antenna in the array of antenna structures 300 of FIG. 3 also includes pin feeds 326, 328, 330, 334. The pin feeds 326, 328, 330, 334 may be used to connect a radio frequency (RF) signal to the each of the reconfigurable antennas of the array of antenna structures 300. More specifically, as illustrated in FIG. 3, the pin feed 326 may be used to connect an RF signal to the patch 318, the pin feed 328 may be used to connect an RF signal to the patch 322, the pin feed 330 may be used to connect an RF signal to the patch 324, the pin feed 334 may be used to connect an RF signal to the patch 320.

As in the illustrated example of FIGS. 1 and 2, in the illustrated example of FIG. 3, the pin feeds 326, 328, 330, 334 are not directly connected to any of the parasitic slots 310, 312, 314, 316. The parasitic slots 310, 312, 314, 316, however, may impact the radiation pattern of the array of the antenna structure 300. That is, the general direction of signal transmission may change depending on the state of the parasitic slots 310, 312, 314, 316 as is described herein. In other examples, one or more antenna structures may be oriented opposite one or more other antenna structures. For example, one antenna structure may have a ground plane on the same side as another antenna structure's patch. In such an example discontinuities in the metal planes may be required, e.g., to separate a ground plane for one antenna structure from a patch of another antenna structure.

The illustrated example of FIG. 3 includes an array of antenna structures 300 that has a series of patches 318, 320, 322, 324 that may generally be on the same plane. The plane may generally be a flat area of metal just above the substrate 336. The patches 318, 320, 322, 324 in the plane may each form a patch of a patch antenna. The patch is generally a flat rectangular sheet of metal. It will be understood, however that the particular shape of the sheet of metal (or another conductor) may vary depending on the particular implementation.

As described herein, several of the patch antennas include parasitic slots 310, 312, 314, 316. The first parasitic slots are each formed by two opposing portions of a second conductor plane. The second conductor plane may be on the bottom of the substrate 336. (It will be understood that the words "top" and "bottom" are relative to the orientation of the diagram in the figure.) As described herein, the opposing portions of the second conductor plane are each separated by cut-outs in the second conductor plane.

The array of antenna structures 300 of FIG. 3 may be considered to be a "pattern reconfigurable antenna array" or a "radiation pattern reconfigurable antenna array" because the radiation patterns of the antenna array are reconfigurable. The electrical energy radiated by the array of antenna structures 300 or the energy received by the array of antenna structures 300 may be, for example, primarily in the x-direction, primarily in the y-direction, or primarily in the z-direction based on the state of the switches. Generally, switches associated with antenna structures 302, 304, 308 may be configured to point one or more of the antenna structures 302, 304, 308 in the same direction at the same time. The switches may be controlled to be "on" or "off" to intentional modification of the spherical distribution of the radiation pattern of the one or more of the antenna structures 302, 304, 308 and accordingly, the array of antenna structures 300. Note that in the illustrated example of FIG. 3, antenna structure 306 does not include any parasitic slots. Accordingly, antenna structure 306 is generally not considered to be a pattern reconfigurable antenna or radiation pattern reconfigurable antenna, however, the array of antenna structures 300 may be considered to be a "pattern reconfigurable antenna array" or a "radiation pattern reconfigurable antenna array."

Figure 4:
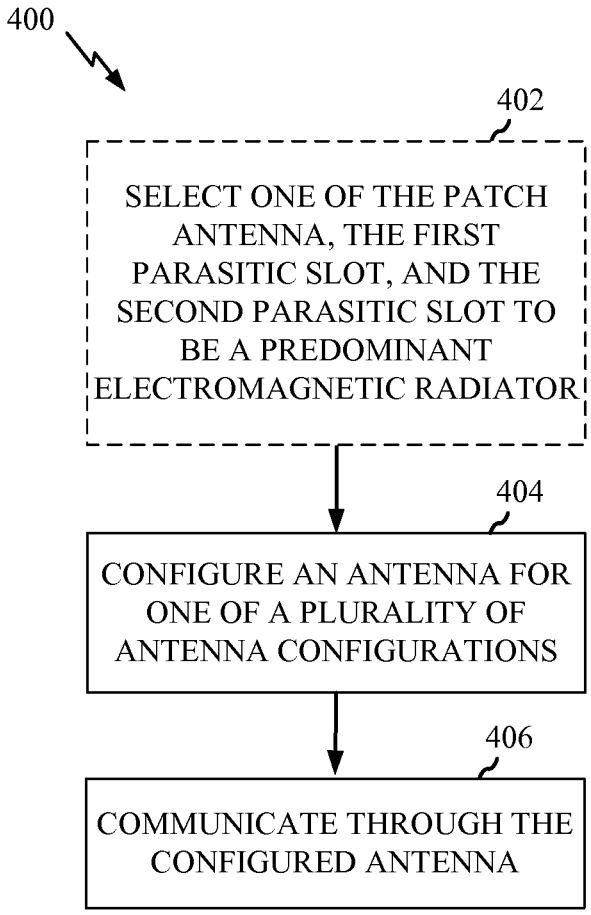
FIG. 4 is a flowchart of a method related to reconfigurable antennas in accordance with this disclosure.

FIG. 4 is a flowchart 400 of a method related to reconfigurable antennas in accordance with this disclosure. Optionally, at block 402, circuitry may select one of the patch antenna, the first parasitic slot of the one or more parasitic slots, and the second parasitic slot of the one or more parasitic slots to be a predominant electromagnetic radiator. The selection may be made by setting a state of the first switch and the second switch. The patch antenna is the predominant electromagnetic radiator when the first switch is on and the second switch is on. The first parasitic slot of the one or more parasitic slots is the predominant electromagnetic radiator when the first switch is off and the second switch is on. The second parasitic slot of the one or more parasitic slots is the predominant electromagnetic radiator when the first switch is on and the second switch is off. The switches may be controlled by processing circuitry, digital logic, or other circuitry designed to select an antenna direction and point the antenna.

At block 404, circuitry configures an antenna for one of a plurality of antenna configurations. The configuration occurs by disabling or enabling one or more parasitic slots of the antenna. The antenna includes a patch antenna and one or more parasitic slots. The patch antenna includes a first conductor plane and a second conductor plane. The second conductor plane is configured to provide a ground plane for the first conductor plane. A first parasitic slot of the one or more parasitic slots is formed in the second conductor plane. The first parasitic slot of the one or more parasitic slots is formed by a first set of two opposing portions of the second conductor plane. The first set of two opposing portions is separated by a first cutout in the second conductor plane.

At block 406, transceiver, receiver, transmitter circuitry, or other circuitry communicates through the configured antenna. The transceiver, receiver, transmitter circuitry, or other circuitry may send or receive signals to or from the antenna through a connection to the pin feeds 106, 326, 328, 330, 334 that may be part of the reconfigurable antenna 100 or the array of antenna structures 300 (e.g., with one pin to each antenna in the array of antenna structures 300).

In some examples, disabling or enabling the first parasitic slot of the one or more parasitic slots of the antenna includes connecting or disconnecting the first set of two opposing portions of the second conductor plane using a first switch. The first switch may be connected between the first set of two opposing portions of the second conductor plane. Additionally, the first parasitic slot of the one or more parasitic slots and the first switch may form a first reconfigurable parasitic slot.

In some examples, the antenna may further include a second parasitic slot of the one or more parasitic slots and a second switch. The second switch may be configured to enable or disable the second parasitic slot of the one or more parasitic slots.

Disabling or enabling the second parasitic slot of the one or more parasitic slots of the antenna may include connecting or disconnecting a second set of two opposing portions of the second conductor plane using a second switch. Furthermore, the second switch may be connected between the second set of two opposing portions of the second conductor plane separated by a second cutout. The second parasitic slot of the one or more parasitic slots and the second switch may form a second reconfigurable parasitic slot. In some examples, the second reconfigurable parasitic slot of the one or more parasitic slots may be formed in the second conductor plane.

In some examples, the means for selecting one of the patch antenna, the first parasitic slot of the one or more parasitic slots, and the second parasitic slot of the one or more parasitic slots to be a predominant electromagnetic radiator may include one or more of processing circuitry, digital logic, or other circuitry designed to select an antenna direction and point the antenna.

The means for selecting one of the patch antenna, the first parasitic slot of the one or more parasitic slots, and the second parasitic slot of the one or more parasitic slots to be a predominant electromagnetic radiator may include one or more switches. For example, the selection may be made by setting a state of the first switch and the second switch. The patch antenna is the predominant electromagnetic radiator when the first switch is on and the second switch is on. The first parasitic slot of the one or more parasitic slots is the predominant electromagnetic radiator when the first switch is off and the second switch is on. The second parasitic slot of the one or more parasitic slots is the predominant electromagnetic radiator when the first switch is on and the second switch is off. The switches may be controlled by processing circuitry, digital logic, or other circuitry designed to select an antenna direction and point the antenna.

In some examples, the means for configuring an antenna for one of a plurality of antenna configurations may include processing circuitry, digital logic, or other circuitry designed to configuring an antenna for one of a plurality of antenna configurations. In some examples, the means for configuring an antenna for one of a plurality of antenna configurations may include one or more switches.

As described herein, the configuration of an antenna occurs by disabling or enabling one or more parasitic slots of the antenna. The antenna includes a patch antenna and one or more parasitic slots. The patch antenna includes a first conductor plane and a second conductor plane. The second conductor plane is configured to provide a ground plane for the first conductor plane. A first parasitic slot of the one or more parasitic slots is formed in the second conductor plane. The first parasitic slot of the one or more parasitic slots is formed by a first set of two opposing portions of the second conductor plane. The first set of two opposing portions is separated by a first cutout in the second conductor plane.

In some examples, the means for communicating using the antenna may include one or more of a transceiver, a receiver, a transmitter circuitry, or other circuitry that may communicate using a configured antenna. The transceiver, receiver, transmitter circuitry, or other circuitry may send or receive signals to or from the antenna through a connection to the pin feeds 106, 326, 328, 330, 334 that may be part of the reconfigurable antenna 100 or the array of antenna structures 300, as described herein.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "at least one of A, B, and C," and "A, B, C, or any combination thereof" include any combination of A, B, and/or C, and may include multiples of A, multiples of B, or multiples of C. Specifically, combinations such as "at least one of A, B, or C," "at least one of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed as a means plus function unless the element is expressly recited using the phrase "means for."

What is claimed is:

1. A reconfigurable antenna including a patch antenna and one or more parasitic slots, the reconfigurable antenna comprising:

the patch antenna, the patch antenna including:

a first conductor plane, and a second conductor plane, the second conductor plane configured to provide a ground plane for the first conductor plane;

a first parasitic slot of the one or more parasitic slots formed in the second conductor plane, the first parasitic slot of the one or more parasitic slots formed by a first set of two opposing portions of the second conductor plane, the first set of two opposing portions separated by a first cutout in the second conductor plane; and a first switch configured to enable or disable the first parasitic slot of the one or more parasitic slots.

2. The reconfigurable antenna of claim 1, wherein the first switch is connected between the first set of two opposing portions of the second conductor plane, the first parasitic slot of the one or more parasitic slots and the first switch forming a first reconfigurable parasitic slot.

3. The reconfigurable antenna of claim 1, further comprising a second parasitic slot of the one or more parasitic slots and a second switch, the second switch configured to enable or disable the second parasitic slot of the one or more parasitic slots.

4. The reconfigurable antenna of claim 3, wherein the second switch is connected between a second set of two opposing portions of the second conductor plane separated by a second cutout.

5. The reconfigurable antenna of claim 4, wherein the second parasitic slot of the one or more parasitic slots and the second switch form a second reconfigurable parasitic slot.

6. The reconfigurable antenna of claim 5, wherein the second reconfigurable parasitic slot of the one or more parasitic slots is formed in the second conductor plane.

7. The reconfigurable antenna of claim 3, wherein one of the patch antenna, the first parasitic slot, and the second parasitic slot of the one or more parasitic slots are a predominant electromagnetic radiator based on a state of the first switch and a state of the second switch.

8. The reconfigurable antenna of claim 7, wherein the patch antenna is the predominant electromagnetic radiator when the first switch is on and the second switch is on, wherein the first parasitic slot of the one or more parasitic slots is the predominant electromagnetic radiator when the first switch is off and the second switch is on, and wherein the second parasitic slot of the one or more parasitic slots is the predominant electromagnetic radiator when the first switch is on and the second switch is off.

9. The reconfigurable antenna of claim 3, further comprising:

a second patch antenna including:

a third conductor plane, and a fourth conductor plane, the fourth conductor plane configured to provide a ground plane for the third conductor plane;

a third parasitic slot of the one or more parasitic slots formed in the fourth conductor plane, the third parasitic slot of the one or more parasitic slots formed by a third set of two opposing portions of the fourth conductor plane, the third set of two opposing portions separated by a third cutout in the fourth conductor plane; and a third switch configured to enable or disable the third parasitic slot of the one or more parasitic slots;

a third patch antenna including:

a fifth conductor plane, and a sixth conductor plane, the sixth conductor plane configured to provide a ground plane for the fifth conductor plane;

a fourth parasitic slot of the one or more parasitic slots formed in the sixth conductor plane, the fourth parasitic slot of the one or more parasitic slots formed by a fourth set of two opposing portions of the sixth conductor plane, the fourth set of two opposing portions separated by a fourth cutout in the sixth conductor plane;

a fourth switch configured to enable or disable the fourth parasitic slot of the one or more parasitic slots; and a fourth patch antenna including:

a seventh conductor plane, and an eighth conductor plane, the fourth conductor plane configured to provide a ground plane for the seventh conductor plane.

10. The reconfigurable antenna of claim 9, wherein the second conductor plane, the fourth conductor plane, the sixth conductor plane and the eighth conductor plane comprise a single conductor plane, and wherein the first conductor plane, the third conductor plane, the fifth conductor plane and the seventh conductor plane are coplanar.

11. The reconfigurable antenna of claim 9, wherein a first switch state is shared between the first parasitic slot of the one or more parasitic slots and the third parasitic slot of the one or more parasitic slots and a second switch state is shared between the second parasitic slot of the one or more parasitic slots and the fourth parasitic slot of the one or more parasitic slots.

12. The reconfigurable antenna of claim 1, wherein the first conductor plane and the second conductor plane are parallel to each other.

13. The reconfigurable antenna of claim 1, further comprising a dielectric between the first conductor plane and the second conductor plane.

14. A method of a reconfigurable a reconfigurable antenna, comprising:

configuring an antenna for one of a plurality of antenna configurations by disabling or enabling one or more parasitic slots of the antenna, the antenna comprising a patch antenna and said one or more parasitic slots, the patch antenna including a first conductor plane and a second conductor plane, the second conductor plane being configured to provide a ground plane for the first conductor plane, a first parasitic slot of the one or more parasitic slots being formed in the second conductor plane, the first parasitic slot of the one or more parasitic slots being formed by a first set of two opposing portions of the second conductor plane, the first set of two opposing portions being separated by a first cutout in the second conductor plane; and communicating through the configured antenna.

15. The method of claim 14, wherein disabling or enabling the first parasitic slot of the one or more parasitic slots of the antenna comprises connecting or disconnecting the first set of two opposing portions of the second conductor plane using a first switch, the first switch connected between the first set of two opposing portions of the second conductor plane, the first parasitic slot of the one or more parasitic slots and the first switch forming a first reconfigurable parasitic slot.

16. The method of claim 15, further comprising enabling or disabling a second parasitic slot of the one or more parasitic slots using a second switch configured to enabling or disabling the second parasitic slot.

17. The method of claim 16, wherein disabling or enabling the second parasitic slot of the one or more parasitic slots of the antenna comprises connecting or disconnecting a second set of two opposing portions of the second conductor plane using a second switch, the second switch connected between the second set of two opposing portions of the second conductor plane separated by a second cutout, the second parasitic slot of the one or more parasitic slots and the second switch forming a second reconfigurable parasitic slot.

18. The method of claim 16, further comprising selecting one of the patch antenna, the first parasitic slot, and the second parasitic slot of the one or more parasitic slots to be a predominant electromagnetic radiator by setting a state of the first switch and the second switch, wherein the patch antenna is the predominant electromagnetic radiator when the first switch is on and the second switch is on, wherein the first parasitic slot of the one or more parasitic slots is the predominant electromagnetic radiator when the first switch is off and the second switch is on, and wherein the second parasitic slot of the one or more parasitic slots is the predominant electromagnetic radiator when the first switch is on and the second switch is off.

19. A reconfigurable antenna comprising:

means for configuring an antenna for one of a plurality of antenna configurations by disabling or enabling one or more parasitic slots of the antenna, the antenna comprising a patch antenna and said one or more parasitic slots, the patch antenna including a first conductor plane and a second conductor plane, the second conductor plane being configured to provide a ground plane for the first conductor plane, a first parasitic slot of the one or more parasitic slots being formed in the second conductor plane, the first parasitic slot of the one or more parasitic slots being formed by a first set of two opposing portions of the second conductor plane, the first set of two opposing portions being separated by a first cutout in the second conductor plane; and means for communicating through the configured antenna.

20. The reconfigurable antenna of claim 19, wherein disabling or enabling the first parasitic slot of the one or more parasitic slots of the antenna comprises means for connecting or disconnecting the first set of two opposing portions of the second conductor plane using a first switch, the first switch connected between the first set of two opposing portions of the second conductor plane, the first parasitic slot of the one or more parasitic slots and the first switch forming a first reconfigurable parasitic slot.

21. The reconfigurable antenna of claim 20, wherein the antenna further comprises a second parasitic slot of the one or more parasitic slots and a second switch, the second switch configured to enable or disable the second parasitic slot of the one or more parasitic slots.

22. The reconfigurable antenna of claim 21, wherein disabling or enabling the second parasitic slot of the one or more parasitic slots of the antenna comprises connecting or disconnecting a second set of two opposing portions of the second conductor plane using a second switch, the second switch connected between the second set of two opposing portions of the second conductor plane separated by a second cutout, the second parasitic slot of the one or more parasitic slots and the second switch forming a second reconfigurable parasitic slot.

23. The reconfigurable antenna of claim 22, wherein the second reconfigurable parasitic slot of the one or more parasitic slots is formed in the second conductor plane.

24. The reconfigurable antenna of claim 21, selecting one of the patch antenna, the first parasitic slot, and the second parasitic slot of the one or more parasitic slots to be a predominant electromagnetic radiator by setting a state of the first switch and the second switch.

25. The reconfigurable antenna of claim 24, wherein the patch antenna is the predominant electromagnetic radiator when the first switch is on and the second switch is on, wherein the first parasitic slot of the one or more parasitic slots is the predominant electromagnetic radiator when the first switch is on and the second switch is off, and wherein the second parasitic slot of the one or more parasitic slots is the predominant electromagnetic radiator when the first switch is off and the second switch is on.

26. The reconfigurable antenna of claim 21, the reconfigurable antenna further comprising:

a second patch antenna including:

a third conductor plane, and a fourth conductor plane, the fourth conductor plane configured to provide a ground plane for the third conductor plane;

a third parasitic slot of the one or more parasitic slots formed in the second conductor plane, the third parasitic slot of the one or more parasitic slots formed by a third set of two opposing portions of the fourth conductor plane, the third set of two opposing portions separated by a third cutout in the fourth conductor plane;

a third patch antenna including:

a fifth conductor plane, and a sixth conductor plane, the sixth conductor plane configured to provide a ground plane for the third patch antenna;

a fourth parasitic slot of the one or more parasitic slots formed in the sixth conductor plane, the fourth parasitic slot of the one or more parasitic slots formed by a fourth set of two opposing portions of the sixth conductor plane, the fourth set of two opposing portions separated by a fourth cutout in the sixth conductor plane; and a fourth patch antenna including:

a seventh conductor plane, and an eighth conductor plane, the eighth conductor plane configured to provide a ground plane for the seventh conductor plane.

27. The reconfigurable antenna of claim 26, wherein the second conductor plane, the fourth conductor plane, the sixth conductor plane and the eighth conductor plane of the reconfigurable antenna comprise a single conductor plane and wherein the first conductor plane, the third conductor plane, the fifth conductor plane, and the seventh conductor plane are coplanar.

28. The reconfigurable antenna of claim 26, wherein the first switch of the reconfigurable antenna is shared between the first parasitic slot of the one or more parasitic slots and the third parasitic slot of the one or more parasitic slots and wherein the second switch of the reconfigurable antenna is shared between the second parasitic slot of the one or more parasitic slots and the fourth parasitic slot of the one or more parasitic slots.

29. The reconfigurable antenna of claim 19, wherein the first conductor plane and the second conductor plane of the reconfigurable antenna are parallel to each other.

30. The reconfigurable antenna of claim 19, wherein the reconfigurable antenna further comprises a dielectric between the first conductor plane and the second conductor plane.

* * * * *